United States Patent [19]

Harken et al.

[11] 4,160,541

[45] Jul. 10, 1979

[54] SWIVEL BASE

[75] Inventors: Peter O. Harken, Pewaukee, Wis.; William E. Lawson, Stillwater, Minn.

[73] Assignee: Vanguard, Inc., Pewaukee, Wis.

[21] Appl. No.: 864,512

[22] Filed: Dec. 27, 1977

[51] Int. Cl.[2] ..... B66D 1/36

[52] U.S. Cl. ..... 254/192; 114/218; 308/219

[58] Field of Search ..... 254/192, 190 R, 195, 254/194, 197, 150 R, 183, 138; 114/102, 108, 111, 218, 199; 242/85; 24/134 R; 308/219, 232, 139, 157

[56] References Cited

U.S. PATENT DOCUMENTS

| | | | |
|---|---|---|---|
| 2,809,049 | 10/1957 | Carlson | 308/219 |
| 3,103,394 | 9/1963 | Moroney | 308/219 |
| 3,580,209 | 5/1971 | Olson | 114/218 |
| 3,815,538 | 6/1974 | Jurgich | 114/218 |

FOREIGN PATENT DOCUMENTS

| | | | |
|---|---|---|---|
| 742578 | 12/1955 | United Kingdom | 308/219 |

*Primary Examiner*—Trygve M. Blix
*Assistant Examiner*—Kenneth W. Noland
*Attorney, Agent, or Firm*—Gary, Juettner & Pyle

[57] ABSTRACT

A sailboat swivel base for supporting a block and a rotatable arm includes a central rotatable post for supporting the block and a separate annular bearing system, located axially outwardly of the post, for rotatably supporting the arm against bending movements that would otherwise cause distortion, undue wear, and sloppiness in the base. The separate bearing system comprises annular sets of rotary bearings in the base that confine and support opposite sides of the end of the arm, the bearing sets being carried in annular recesses between the arm and the base.

6 Claims, 4 Drawing Figures

SWIVEL BASE

BACKGROUND OF THE INVENTION

This invention relates to block and tackle equipment and more particularly to equipment known as a "swivel base" that is used on a large variety of sailing craft. The swivel base is normally affixed to the craft and is used to support an upstanding block or pulley. In addition, the base supports an outwardly extending arm having one end rotatably mounted on the base and the other end carrying a cleat or line securement device.

In using the aforesaid arrangement, a line is passed between the pulley and the base, and the bitter end is led to the securement device on the arm, typically a cam cleat. The other end of the line is normally attached to a sail, boom or other working parts such that the operator can make adjustments by either pulling in or releasing the line and then securing the bitter end to the line securement device.

As a specific example of the foregoing, swivel bases are beneficially employed in main sheet systems, the working end of the line attached to the boom and passing through a plural block sysem and downwardly around the block of the swivel base. The arm and block on the centrally mounted swivel base are capable of rotating about a common axis and are rotated from one side to the other when changing tacks, thus allowing the bitter end of the main sheet to be directly and freely accessible to the operator. The arm typically extends upwardly and outwardly from the base, allowing better or more convenient access to the securement device.

Although the basic form of a swivel base is known per se, all known constructions have the common problem of tending to fatique, loosen and become sloppy due to considerable repeated bending moments exerted on the lever arm. Excessive free play in the lever arm greatly increases the difficulty of releasing the line from the securement device. Also, bending moments on the block and arm are concentrated in the swivel base, causing uneven bearing load, which may result in binding in the pivot or failure of the base.

Prior art swivel bases have utilized small diameter sliding bearing surfaces for supporting the block and the arm, but such arrangements have not proved sufficiently durable to withstand the considerable loads and bending moments exerted thereon.

SUMMARY OF THE INVENTION

In accordance with the present invention, the swivel base comprises a generally cylindrical base having upper and lower interfitting portions with a central solid portion for rotatably receiving the upstanding post of a bearing block. The arm is rotatably mounted on the base by a circular opening in the end of the arm extending around the central portion of the base. Annular sets of rotatable thrust bearing means, such as ball bearings, are carried in respective recesses between the base and the cam arm and bear against opposite surfaces of the arm outwardly of the opening therein.

The rotatable bearings support both sides of the cam arm in a positive fashion, thereby relieving and distributing loads imposed upon the base due to bending moments on the arm and on the block support post. At the same time, the arm may be rotated about the base without concern of binding and repeated stresses do not tend to fatique, stretch or loosen the assembly. The arrangement also allows the bearings to be located in the outermost peripheny of the base for maximum support and load carrying ability.

DESCRIPTION OF THE PREFERRED EMBODIMENT

Figure 1:
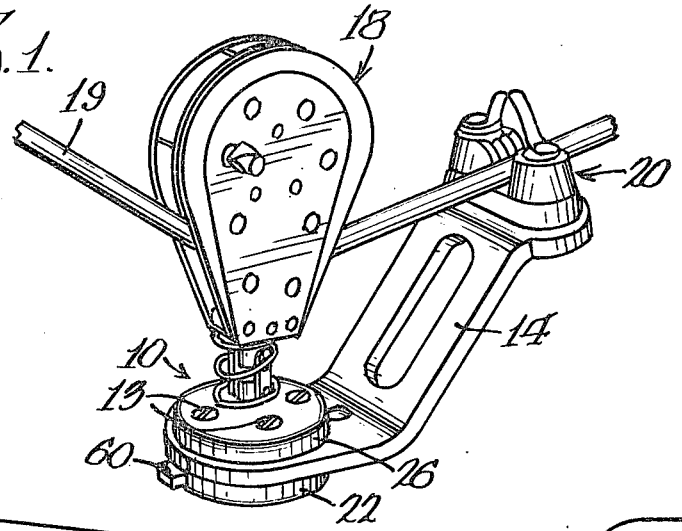
FIG. 1 is a perspective new of a swivel cam base as utilized with a pulley or block and a cam cleat.

The swivel base, shown generally at 10 in FIG. 1, comprises a generally cylindrical bearing assembly 12 arranged to be secured, for example, to the deck, floor or other stationary part of a sailboat by means of bolts 13 or the like. An upstanding swivel pin 16 is rotatably mounted in the central portion of the assembly and supports a conventional pulley or bearing block 18 which receives a control line 19 as is well known in the art. For many applications, the block 18 may include a one-way ratchet mechanism to provide resistance to pull on the line. A plate-like cam arm 14 is rotatably supported at one end in the bearing block 12 and carries at its other end a line securement device such as a conventional cam cleat 20 by means of which the line 19 may be quickly locked in a desired position or quickly released therefrom.

Figure 3:
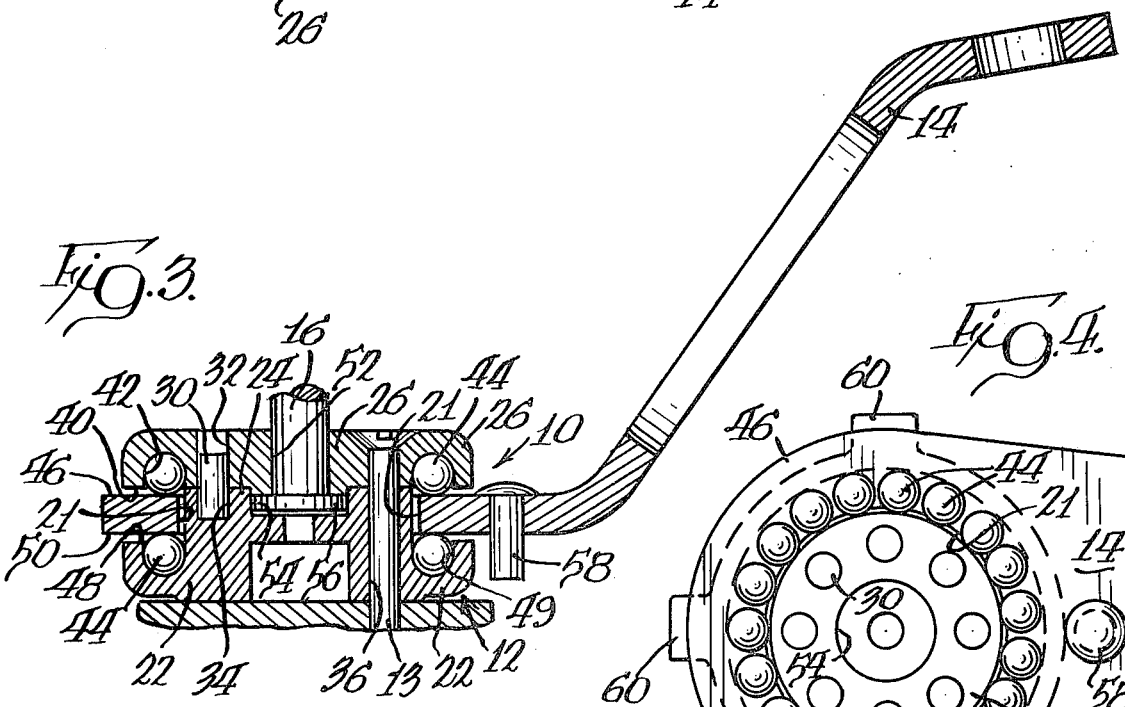
FIG. 3 is a vertical sectional view taken along line 3—3 of FIG. 2.

The cam cleat shown at 20 includes a pair of rotatable spring loaded jaws bearing teeth which releasably grip the line 19. As shown in FIGS. 1 and 3, the arm 14 is formed in a manner whereby the cam cleat 20 will be supported adjacent the exit side of the block 18 and in a spaced relationship therewith. The angle on which the cleat 20 is supported may be adjusted by the use of one or more wedges 21 (FIG. 3) between the arm and the cleat. Although the cam cleat 20 is shown mounted on the upper surface of the arm 14, it is also possible to mount the cam cleat on the opposite surface with the line extending through an elongated slot 23 in an intermediate portion of the arm. Also, a -U-strap 25 is preferably secured between the pivots of the two jaws to hold the line near the cleat.

Figure 2:
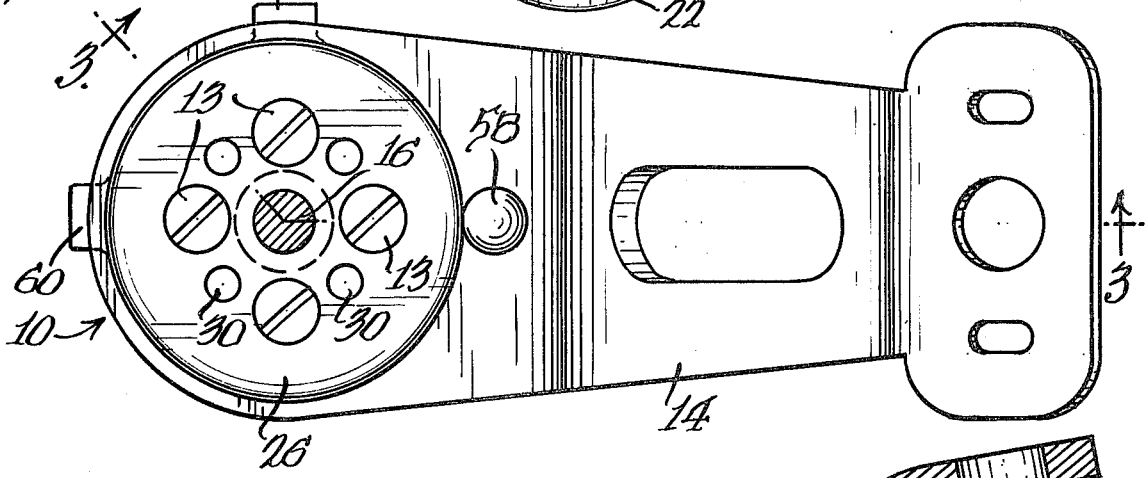
FIG. 2 is a top plan view of the preferred form of the device shown in FIG. 1.
Figure 4:
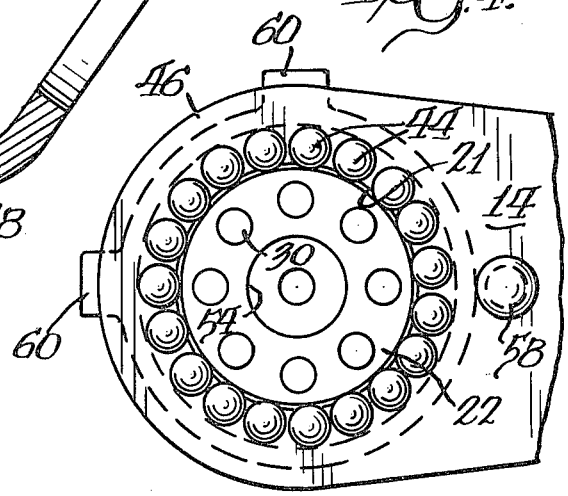
FIG. 4 is a view similar to FIG. 2 but with the top plate removed.

The swivel base construction is best seen with reference to FIGS. 2–4. The arm 14 is preferably made of high strength flat stock and has a circular opening 21 at one end through which is received the bearing assembly 12. In the preferred form the bearing assembly comprises a lower portion or bottom plate 22 having a centrally located boss 24 received through the opening 21 of cam arm 14. A corresponding upper portion or top plate 26 abuts the end face of boss 24 and the two portions are held in assembled relationship by a plurality of pins 30 press fit in aligned pin holes 32 and 34 in lower portion 22 and in upper portion 26 respectively. Separate mounting holes 36 are provided to receive screws or bolt and nut assemblies 13 by means of which the device is secured to the boat.

The top plate 26 has a lower face 40 with a downwardly facing annular recess 42 in the outermost periphery containing a plurality of rotatable bearings, such as ball bearings 44 in operative engagement with the flat top surface 46 of cam arm 14, the top surface 46 being held in spaced relationship with lower face 40 by the bearings.

Similarly, the bottom plate 22 has an upper face 48 with an upwardly facing annular recess 49 containing a plurality of rotatable bearings 44 in operative engagement with the bottom surface 50 of the cam arm 14. The upper face 48 is held in spaced relationship with bottom surface 50 by the bearings 45.

Although the bearings 44 and 45 are preferably sets of ball bearings, it will be apparent that roller bearings may also be used for either set. Also, although the races for the bearings are preferably formed in bottom plate 22 and top plate 26, it will be apparent that bearing receiving grooves could be provided in the arm 14.

It will be noted that the annular recesses 42 and 49, in which the upper and lower thrust bearing means are received, are positioned toward the outermost periphery of the respective plates and radially outwardly of the press fit pins 30 and the mounting screws or bolts 13. This construction feature not only distributes the loads imposed on the unit over a wide area but also provides increased stability for bending moments on the arm.

The top plate 26 has a central opening 52 communicating with a cylindrical counterbore 54 in the bottom plate 22. The enlarged cylindrical head 56 of the conventional swivel post 16 is rotatably received in the counterbore 54 and the body of the post extends through opening 52. The other end of the post 16 is hinged to the block 18. A helical spring 55 is located between the base 10 and the block 18 for resiliently supporting the block in an upright position.

A stop pin 58 may be positioned in the cam arm for engagement by stop lugs 60 on bottom plate 22 to limit the amount of rotational movement of cam arm 14 about the bearing block 12.

The swivel base, as described above, provides substantial improvements over prior art devices of this nature. In prior art devices, the rotary joint for the block post 16 and the rotary joint for the arm 14 utilized common sliding bearing surfaces, which were prone to fatigue, binding and excessive wear. As a result, the arm 14 would become loose and make it difficult to release the line from the cleat.

In accordance with the present invention, the bearing surfaces for the post 16 and arm 14 are separate. Another important feature is that the rotary bearing races for the arm are located at the outermost diameter of the base, that is, outwardly of the post 16 and mounting bolts and pins. This feature allows for the greatest possible support of the cam arm against bending moments caused by considerable pull on the line when engaged in the cam cleat or when making adjustments. The rotatable bearings not only result in less wear, but the large diameter races also substantially eliminate fatique in the bearing parts.

Another important feature is that opposite sides of the arm are supported entirely by rotatable bearings, and this allows bending forces on the arm to be more uniformly distributed through the vase while allowing the arm to freely rotate. The use of the interfitting top and bottom members makes it possible to accurately control tolerances between the bearing sets and cam arm, thereby virtually eliminating any free play or tilting of the arm in a direction parallel to its axis of rotation. Finally, the device is simple in design and manufacture while offering substantial improvements to the art.

While the preferred embodiment of the device, with its many advantages, has been described herein, other modifications and improvements may be made without departing from the spirit and scope of the appended claims.

We claim:

1. A swivel base for rotatably supporting a bearing block and one end of an arm having a line securement device at the other end, said base comprising a pair of interfitting plate members, one of said plate members having a boss forming a connecting central portion between said plate members, means in said central portion for rotatably receiving a support post for said bearing block, said one end of said arm having an opening extending around said central portion, an annular recess between each of said plates and said one end of the arm located outwardly of the opening therein, and a plurality of rotatable bearing means in each annular recess for rotatably supporting opposite surfaces of said arm.

2. The swivel base of claim 1 wherein said rotatable bearing means comprise ball bearings.

3. The swivel base of claim 1 wherein said annular recess is provided in each of the plate members at the outer periphery thereof.

4. The swivel base of claim 1 wherein securement means are provided for securing said plates together.

5. The swivel base of claim 4 wherein said securement means are located in said central connecting portion outwardly of the means for rotatably receiving said support post.

6. A swivel base for rotatably supporting a bearing block and one end of an arm extending from the base and having a line securement device mounted on said arm, said base comprising a pair of plate members, means in a central portion of said base for rotatably receiving a support post for said bearing block, said one end of said arm extending between said plates and having an opening therein, an annular recess between each of said plates and said one end of said arm located outwardly of the opening therein, a plurality of rotatable bearing means in each annular recess for rotatably supporting opposite surfaces of said arm, and means spaced inwardly from the opening in said arm for securing said plates together in operative relation with said arm and rotatable bearing means.

* * * * *